US009708724B2

(12) United States Patent
Tsujino et al.

(10) Patent No.: US 9,708,724 B2
(45) Date of Patent: Jul. 18, 2017

(54) ANODE UNIT AND PLATING APPARATUS HAVING SUCH ANODE UNIT

(71) Applicant: EBARA CORPORATION, Tokyo (JP)

(72) Inventors: Junichiro Tsujino, Tokyo (JP); Tsutomu Nakada, Tokyo (JP); Yusuke Tamari, Sacramento, CA (US); Mitsutoshi Yahagi, Tokyo (JP); Akira Owatari, Sacramento, CA (US)

(73) Assignee: Ebara Corporation, Tokyo (JP)

( * ) Notice: Subject to any disclaimer, the term of this patent is extended or adjusted under 35 U.S.C. 154(b) by 236 days.

(21) Appl. No.: 14/629,453

(22) Filed: Feb. 23, 2015

(65) Prior Publication Data

US 2015/0275390 A1 Oct. 1, 2015

Related U.S. Application Data

(60) Provisional application No. 61/944,512, filed on Feb. 25, 2014.

(51) Int. Cl.

| | |
|---|---|
| ***C25C 7/02*** | (2006.01) |
| ***C25C 7/00*** | (2006.01) |
| ***C25C 3/16*** | (2006.01) |
| ***C25C 3/12*** | (2006.01) |
| ***C25B 9/00*** | (2006.01) |
| ***C25B 9/02*** | (2006.01) |
| ***C25D 17/12*** | (2006.01) |
| ***C25D 17/00*** | (2006.01) |

(52) U.S. Cl.
CPC ..... *C25D 17/12* (2013.01); *C25D 17/001* (2013.01); *C25D 17/007* (2013.01)

(58) Field of Classification Search
CPC ..... C25D 17/001; C25D 17/10; C25D 17/12; C25D 17/00; C25D 17/02; C25D 17/007
USPC ..... 204/242, 286.1
See application file for complete search history.

(56) References Cited

U.S. PATENT DOCUMENTS

| | | | | |
|---|---|---|---|---|
| 5,807,469 A * | 9/1998 | Crafts | ..... | C25D 5/022 204/297.06 |
| 8,029,653 B2 | 10/2011 | Yamamoto et al. | | |
| 8,147,660 B1 * | 4/2012 | Mayer | ..... | C25D 17/10 204/230.2 |

FOREIGN PATENT DOCUMENTS

| | | |
|---|---|---|
| JP | H07-1070 | 1/1995 |
| JP | 2002-004095 | 1/2002 |
| JP | 2008-150631 | 7/2008 |

* cited by examiner

*Primary Examiner* — Zulmariam Mendez
(74) *Attorney, Agent, or Firm* — Baker & Hostetler LLP

(57) ABSTRACT

An anode unit capable of forming a metal film having a uniform thickness on a substrate is disclosed. The anode unit includes an anode, a first feeding portion connected to a central portion of the anode, a second feeding portion located on a central axis of the anode and located away from the anode, and arms extending radially from the second feeding portion. The arms are connected to a periphery of the anode.

13 Claims, 15 Drawing Sheets

ANODE UNIT AND PLATING APPARATUS HAVING SUCH ANODE UNIT

CROSS REFERENCE TO RELATED APPLICATION

This document claims priority to U.S. Provisional Patent Application No. 61/944,512 filed Feb. 25, 2014, the entire contents of which are hereby incorporated by reference.

BACKGROUND

In the formation of interconnects of a semiconductor circuit or in the formation of bumps, a method has recently come into use which involves performing plating on a substrate, such as a wafer, to form a metal film or an organic film on the substrate. It is common practice to form interconnects or bumps (protruding connecting electrodes) of gold, silver, copper, solder or nickel, or of a multi-layer laminate of these metals at predetermined sites on the surface of a wafer in which semiconductor circuits or fine interconnects that connect the circuits are formed, and to electrically connect the wafer to electrodes or TAB (Tape Automated Bonding) electrodes of a package substrate via the bumps. Such interconnects or bumps can be formed by various methods, including electroplating, electroless plating, vapor deposition, printing, etc. As the I/O number of semiconductor chip increases and the I/O pitch becomes narrower, electroplating, which can meet such a trend and can form a film at a high rate, has become a common method. A metal film as obtained by electroplating, the most commonly-used technique, is advantageous in high purity, high film-forming rate and easy control of the film thickness.

A typical plating apparatus will now be described with reference to FIG. 13. FIG. 13 is a schematic view of the typical plating apparatus. As shown in FIG. 13, this plating apparatus includes a plating bath 101 for holding a plating solution therein, an anode unit 107, and a substrate holder 104 for holding a substrate W. The anode unit 107 includes an anode 103. The substrate W and the anode 103 are disposed in a vertical position and are opposite each other in the plating solution held in the plating bath 101. A paddle 109, which reciprocates parallel to the surface of the substrate W to agitate the plating solution, is disposed between the anode 103 and the substrate W. By agitating the plating solution with the paddle 109, a sufficient amount of metal ions can be supplied uniformly to the surface of the substrate W.

The anode 103 is coupled to a positive electrode of a power source 105, while the substrate W is coupled to a negative electrode of the power source 105. The substrate W is plated by applying a voltage between the anode 103 and the substrate W. An overflow bath 106 is provided adjacent to the plating bath 101. The plating solution, overflowing the plating bath 101, flows into the overflow bath 106, and is returned into the plating bath 101 through a circulation line 120.

FIG. 14 is a perspective view of the anode unit 107, and FIG. 15 is a side view of the anode unit 107 shown in FIG. 14. As shown in FIGS. 14 and 15, the anode unit 107 includes a feeder belt 110 having a feeding portion 108 for passing an electric current to a central portion of the anode 103. The feeding portion 108 is in contact with only the central portion of the anode 103, and therefore the electric current flows from the central portion to a periphery of the anode 103 as shown by arrows in FIG. 15. Due to an influence of an electrical resistance of the anode 103, the current is lower at the periphery than at the central portion of the anode 103. Consequently, non-uniform electric current flows to the substrate W, and may adversely affect a uniformity of a thickness of a metal film formed on the substrate W.

SUMMARY OF THE INVENTION

According to an embodiment, there is provided an anode unit capable of forming a metal film having a uniform thickness on a substrate, and a plating apparatus provided with such an anode unit.

The below-described embodiments relate to an anode unit for use in plating of a surface of a substrate, such as a wafer, and to a plating apparatus provided with such an anode unit.

In an embodiment, there is provided an anode unit comprising: an anode; a first feeding portion connected to a central portion of the anode; a second feeding portion located on a central axis of the anode and located away from the anode; and arms extending radially from the second feeding portion, the arms being connected to a periphery of the anode.

In an embodiment, the arms are arranged at regular intervals along a circumferential direction of the anode.

In an embodiment, there is provided an anode unit comprising: a first anode; a second anode located away from the first anode and arranged parallel to the first anode; a first feeding portion connected to a central portion of the first anode; a second feeding portion located on a central axis of the second anode and located away from the first anode and the second anode; and arms extending radially from the second feeding portion, the arms being connected to a periphery of the second anode.

In an embodiment, the arms are arranged at regular intervals along a circumferential direction of the second anode.

In an embodiment, there is provided an anode unit comprising: a first anode and a second anode located away from each other and arranged parallel to each other; a feeding portion located on a central axis of the first anode and the second anode and located away from the first anode and the second anode; first arms extending radially from the feeding portion, the first arms being connected to a periphery of the first anode; and second arms extending radially from the feeding portion, the second arms being connected to a periphery of the second anode.

In an embodiment, the first arms are arranged at regular intervals along a circumferential direction of the first anode, and the second arms are arranged at regular intervals along a circumferential direction of the second anode.

In an embodiment, there is provided a plating apparatus comprising: a plating bath for holding a plating solution therein; an anode unit having an anode to be immersed in the plating solution; a substrate holder for holding a substrate to be immersed in the plating solution; and a first power source and a second power source each for applying a voltage between the substrate and the anode. The anode unit includes: a first feeding portion connected to a central portion of the anode, the first feeding portion being electrically connected to the first power source; a second feeding portion located on a central axis of the anode and located away from the anode, the second feeding portion being electrically connected to the second power source; and arms extending radially from the second feeding portion, the arms being connected to a periphery of the anode.

In an embodiment, the arms are arranged at regular intervals along a circumferential direction of the anode.

In an embodiment, the first power source and the second power source are configured to independently apply a voltage between the substrate and the anode.

In an embodiment, there is provided a plating apparatus comprising: a plating bath for holding a plating solution therein; an anode unit having an anode to be immersed in the plating solution; a substrate holder for holding a substrate to be immersed in the plating solution; and a first power source and a second power source each for applying a voltage between the substrate and the anode. The anode unit includes: a first anode; a second anode located away from the first anode and arranged parallel to the first anode; a first feeding portion connected to a central portion of the first anode, the first feeding portion being electrically connected to the first power source; a second feeding portion located on a central axis of the second anode and located away from the first anode and the second anode, the second feeding portion being electrically connected to the second power source; and arms extending radially from the second feeding portion, the arms being connected to a periphery of the second anode.

In an embodiment, the arms are arranged at regular intervals along a circumferential direction of the second anode.

In an embodiment, there is provided a plating apparatus comprising: a plating bath for holding a plating solution therein; an anode unit having a first anode and a second anode to be immersed in the plating solution, the first anode and the second anode being located away from each other and arranged parallel to each other and; a substrate holder for holding a substrate to be immersed in the plating solution; and a power source for applying a voltage between the substrate and the first and second anodes. The anode unit includes: a feeding portion located on a central axis of the first anode and the second anode and located away from the anodes; first arms extending radially from the feeding portion, the first arms being connected to a periphery of the first anode; and second arms extending radially from the feeding portion, the second arms being connected to a periphery of the second anode.

In an embodiment, the first arms are arranged at regular intervals along a circumferential direction of the first anode, and the second arms are arranged at regular intervals along a circumferential direction of the second anode.

Electricity is supplied to the periphery of the anode through the arms extending radially from the feeding portion lying on the central axis of the anode. Therefore, the electric current is allowed to flow uniformly throughout the anode, so that a uniform electric field can be formed between a substrate and the anode. Consequently, a metal film having a uniform thickness can be formed on the substrate.

DESCRIPTION OF EMBODIMENTS

Figure 1:
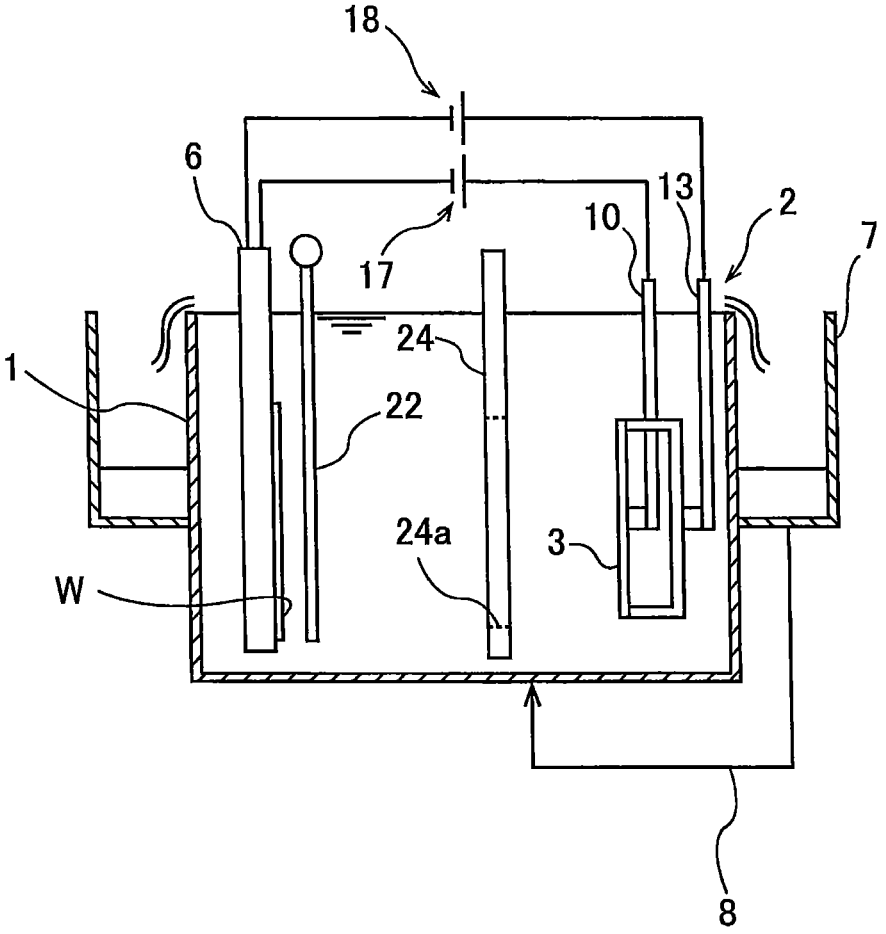
FIG. 1 is a schematic view of a plating apparatus according to an embodiment.

Embodiments will now be described with reference to the drawings. The same reference numerals are used in FIGS. 1 through 12 to refer to the same or corresponding elements, and a duplicate description thereof will be omitted. FIG. 1 is a schematic view of a plating apparatus according to an embodiment. As shown in FIG. 1, the plating apparatus includes a plating bath 1 for holding a plating solution therein, an anode unit 2 having an anode 3, and a substrate holder 6. The substrate holder 6 is configured to detachably hold a substrate W, such as a wafer, and immerse the substrate W in the plating solution held in the plating bath 1. The anode 3 and the substrate W are disposed in a vertical position and opposite each other in the plating solution.

The plating apparatus further includes a paddle 22 for agitating the plating solution in the plating bath 1, and a regulation plate 24 for regulating a distribution of electric potential on the substrate W. The regulation plate 24 is disposed between the paddle 22 and the anode unit 2, and has an opening 24*a* for restricting an electric field in the plating solution. The paddle 22 is located near the surface of the substrate W held by the substrate holder 6, and located between the substrate holder 6 and the anode unit 2. The paddle 22 is disposed in a vertical position, and is configured to reciprocate parallel to the substrate W to thereby agitate the plating solution so that a sufficient amount of metal ions can be supplied uniformly to the surface of the substrate W during plating of the substrate W.

An overflow bath 7 is provided adjacent to the plating bath 1. The overflow bath 7 and the plating bath 1 are coupled by a circulation line 8. Specifically, one end of the circulation line 8 is coupled to a bottom of the overflow bath 7, while the other end of the circulation line 8 is coupled to a bottom of the plating bath 1. The plating solution overflows the plating bath 1 into the overflow bath 7, and is returned into the plating bath 1 through the circulation line 8.

Figure 2:
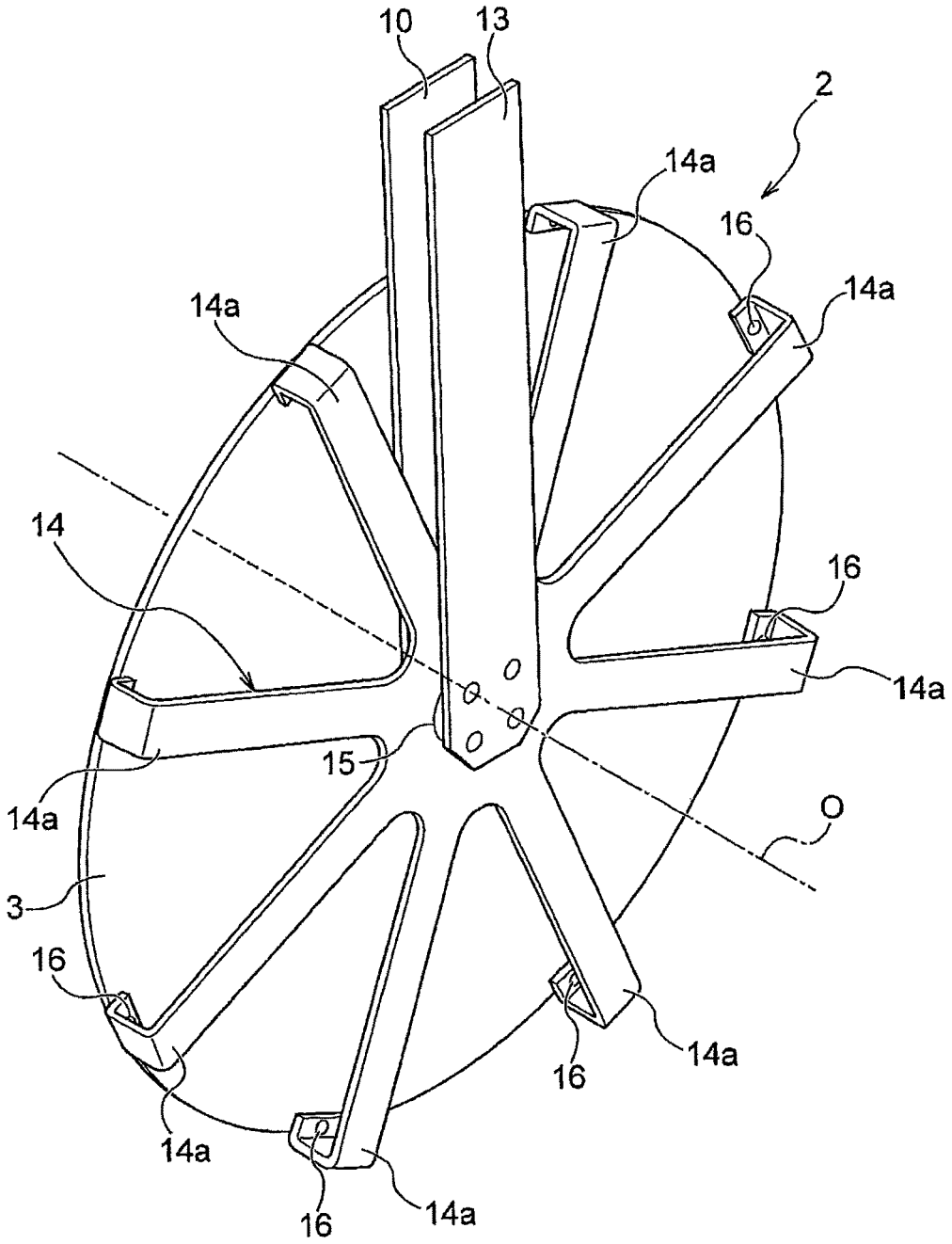
FIG. 2 is a perspective view of an anode unit according to an embodiment as viewed from an opposite side of a surface, facing the substrate, of the anode unit.
Figure 3:
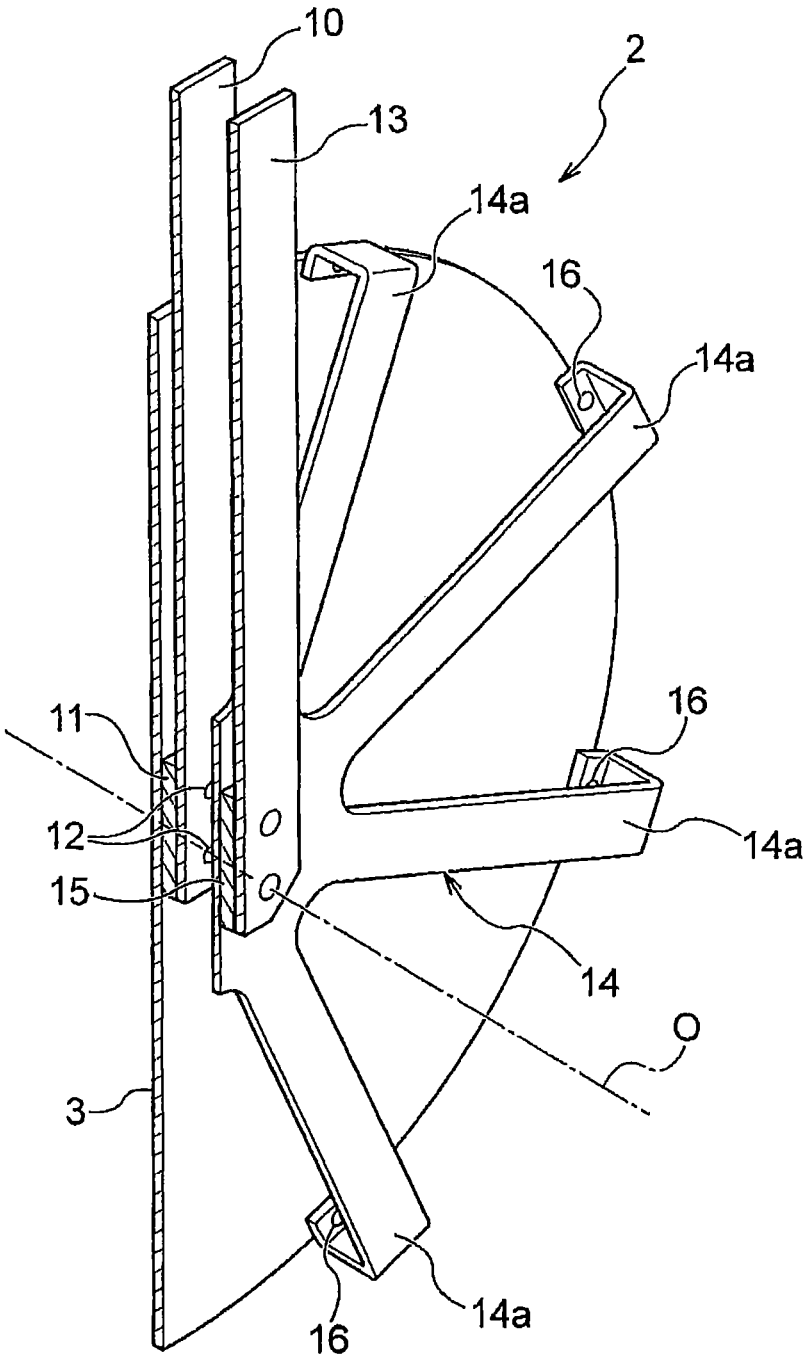
FIG. 3 is a cross-sectional perspective view of the anode unit according to the embodiment.
Figure 4:
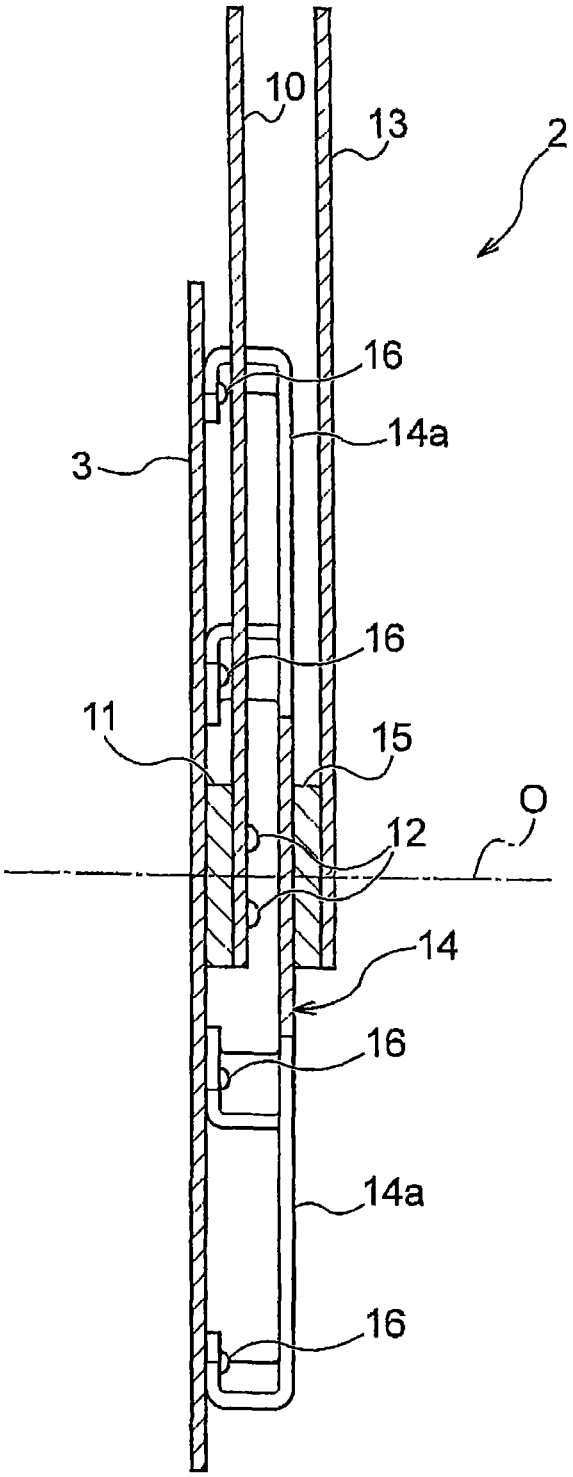
FIG. 4 is a cross-sectional view of the anode unit shown in FIG. 2.

The anode unit 2 will now be described with reference to FIGS. 2 through 4. FIG. 2 is a perspective view of the anode unit 2 of this embodiment as viewed from the opposite side of a surface, facing the substrate W, of the anode unit 2. FIG. 3 is a cross-sectional perspective view of the anode unit 2 shown in FIG. 2. FIG. 4 is a cross-sectional view of the anode unit 2 shown in FIG. 2. As shown in FIGS. 2 through 4, the anode unit 2 includes a disk-shaped anode 3, and a first feeder belt 10 connected to the anode 3. The anode 3 is an insoluble anode formed from a conductor (e.g., titanium) coated with iridium oxide or platinum.

The first feeder belt 10 has a first feeding portion 11 connected to a central portion of the anode 3. This first feeding portion 11 is detachably mounted to the central portion of the anode 3 by fastening tools 12 such as screws, and electrically connects the first feeder belt 10 to the central portion of the anode 3.

The anode unit 2 further includes a second feeder belt 13 having a second feeding portion 15, and a periphery holding member 14 connected to the second feeder belt 13 and electrically connecting the periphery of the anode 3 to the second feeder belt 13. The second feeding portion 15 is located on a central axis O of the anode 3 and is located away from the anode 3. The central axis O is an imaginary line that passes through the central point of the anode 3 and extends perpendicularly to the surface of the anode 3. The first feeder belt 10 and the second feeder belt 13 constitute a first conductive member and a second conductive member, respectively. The shapes of these conductive members are not limited to those of this embodiment.

The periphery holding member 14 has a plurality of arms 14*a* connected to the second feeding portion 15. The arms 14*a* extend radially from the second feeding portion 15, and have distal ends connected to a periphery of the anode 3. The distal ends of the arms 14*a* are bent toward the anode 3, and are fixed to the periphery of the anode 3 by fastening tools 16, such as screws. Each arm 14*a* extends in the radial direction of the anode 3. The arms 14*a* have the same length, and are arranged at regular intervals along a circumferential direction of the anode 3.

While the anode unit 2 of this embodiment has eight arms 14*a*, the number of arms 14*a* is not limited to this embodiment. In addition, while each arm 14*a* is formed from a single component in this embodiment, each arm 14*a* may be constituted by a plurality of components. For example, each arm 14*a* may be constituted by an arm base extending in the radial direction of the anode 3, and a distal end portion removably coupled to the arm base and connected to the periphery of the anode 3.

Figure 5:
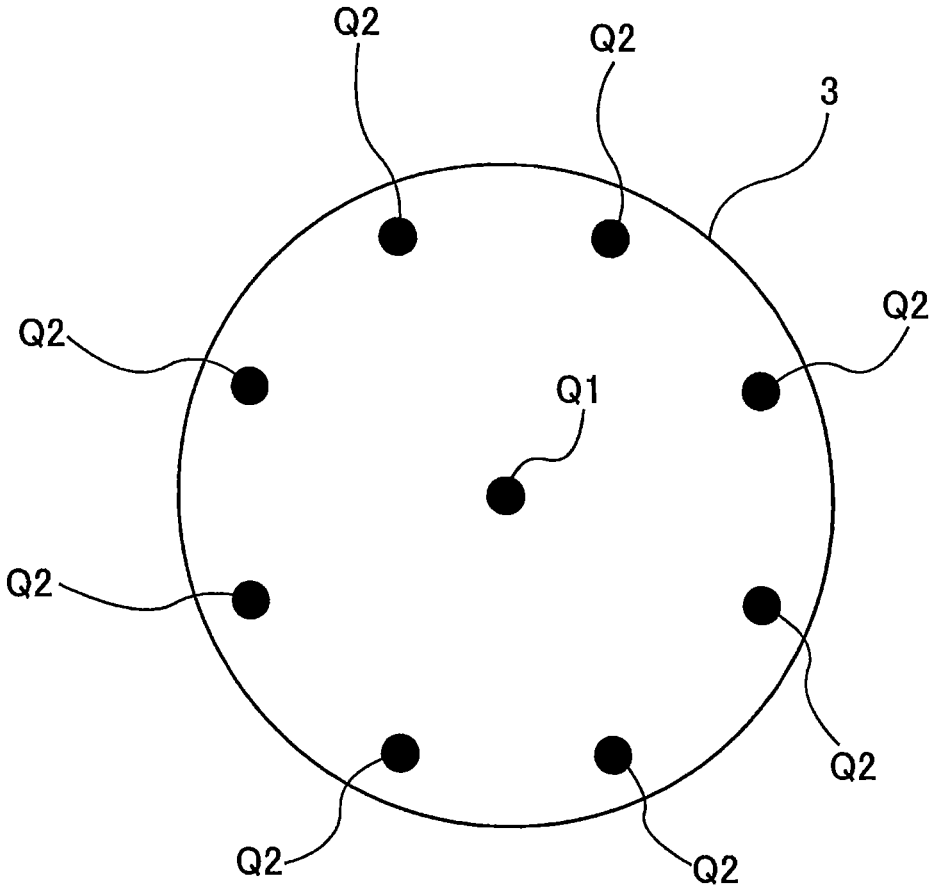
FIG. 5 is a schematic view showing feeding points on the anode.

FIG. 5 is a schematic view showing feeding points on the anode 3. The first feeding portion 11 supplies electricity to the anode 3 at a first feeding point Q1 on the center of the anode 3. The arms 14*a*, connected to the second feeding portion 15, supplies electricity to the anode 3 at a plurality of second feeding points Q2 on the periphery of the anode 3. As can be seen from FIG. 5, the second feeding points Q2 are arranged around the first feeding point Q1 at regular intervals along the circumferential direction of the circular anode 3.

Figure 6:
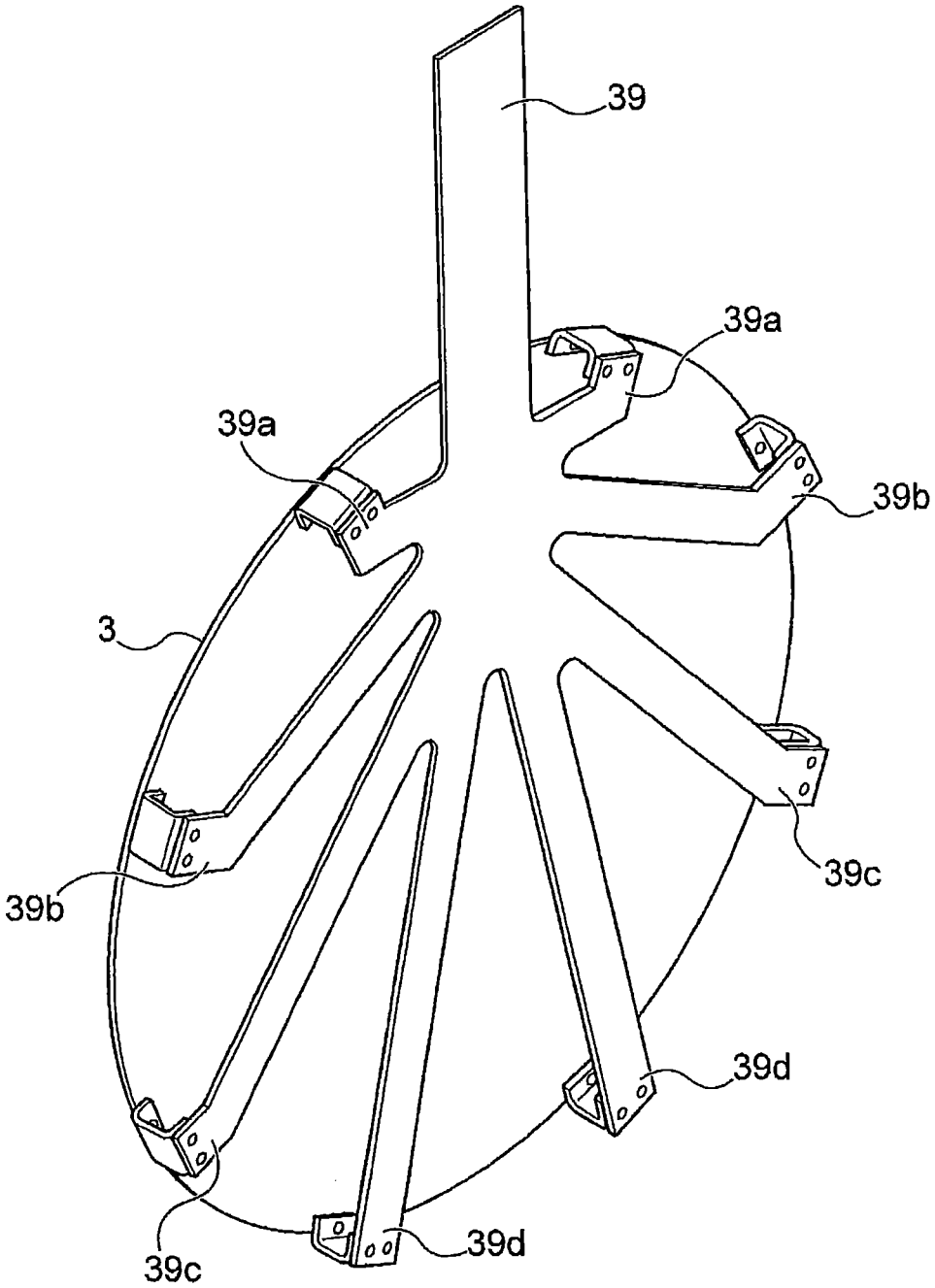
FIG. 6 is a diagram showing a comparative anode unit.

FIG. 6 is a diagram showing a comparative anode unit. The comparative anode unit is the same as the anode unit 2 shown in FIG. 2 in that arms 39*a* to 39*d* of an anode holder 39 shown in FIG. 6 are connected to the periphery of the anode 3. However, these arms 39*a* to 39*d* have different lengths, and therefore electric currents of different magnitudes flow through the arms 39*a* to 39*d*. Consequently, non-uniform electric current flows in the anode 3, resulting in a formation of a metal film having a non-uniform thickness on a substrate W.

In contrast, since the arms 14*a* shown in FIG. 2 have the same length, a uniform electric current can be supplied to the periphery of the anode 3. Further, because the first feeding portion 11 is connected to the central portion of the anode 3, the first feeding portion 11 can supply an electric current to the central portion of the anode 3. The anode unit 2 having such configurations enables an electric current to uniformly flow in the anode 3, thereby forming a uniform electric field between the anode 3 and a substrate W. Therefore, a metal film having a uniform thickness can be formed on the substrate W.

As shown in FIG. 1, the first feeder belt 10 is coupled to a first power source 17 for applying a voltage between the anode 3 and the substrate W, and the second feeder belt 13 is coupled to a second power source 18 for applying a voltage between the anode 3 and the substrate W. More specifically, the first feeder belt 10 is coupled to a positive electrode of the first power source 17, while the substrate W is coupled to a negative electrode of the first power source 17. The second feeder belt 13 is coupled to a positive electrode of the second power source 18, while the substrate W is coupled to a negative electrode of the second power source 18. The first power source 17 and the second power source 18 are configured to independently apply voltage between the anode 3 and the substrate W.

The first power source 17 and the second power source 18 can therefore pass electric currents of the same magnitude or different magnitudes to the central portion and the periphery of the anode 3, respectively. For example, when the electric current at the periphery of the anode 3 is lower than the electric current at the central portion of the anode 3, an output voltage of the second power source 18 is adjusted so as to increase the electric current at the periphery of the anode 3 until the electric current at the periphery of the anode 3 becomes equal to the electric current at the central portion of the anode 3. This enables a uniform electric current to flow throughout the anode 3 in its entirety, thus making it possible to form a metal film having a uniform thickness on the substrate W. A metal film to be formed on the substrate W may be made of, for example, copper (Cu), nickel (Ni), zinc (Zn), solder, or an alloy of tin (Sn) and cobalt (Co).

Plating of the substrate W is performed in the following manner. The anode 3 and the substrate W, held by the substrate holder 6, are placed at predetermined positions in the plating bath 1. In this state, a voltage is applied between the anode 3 and the substrate W, whereby a metal film is formed on the surface of the substrate W. The central portion of the anode 3 is electrically connected to the first feeding portion 11, while the periphery of the anode 3 is electrically connected to the multiple arms 14*a*. Therefore, the magnitudes of electric currents supplied to the central portion and the periphery of the anode 3 can be independently adjusted by adjusting the voltage of the first power source 17 and/or the voltage of the second power source 18.

Figure 7:
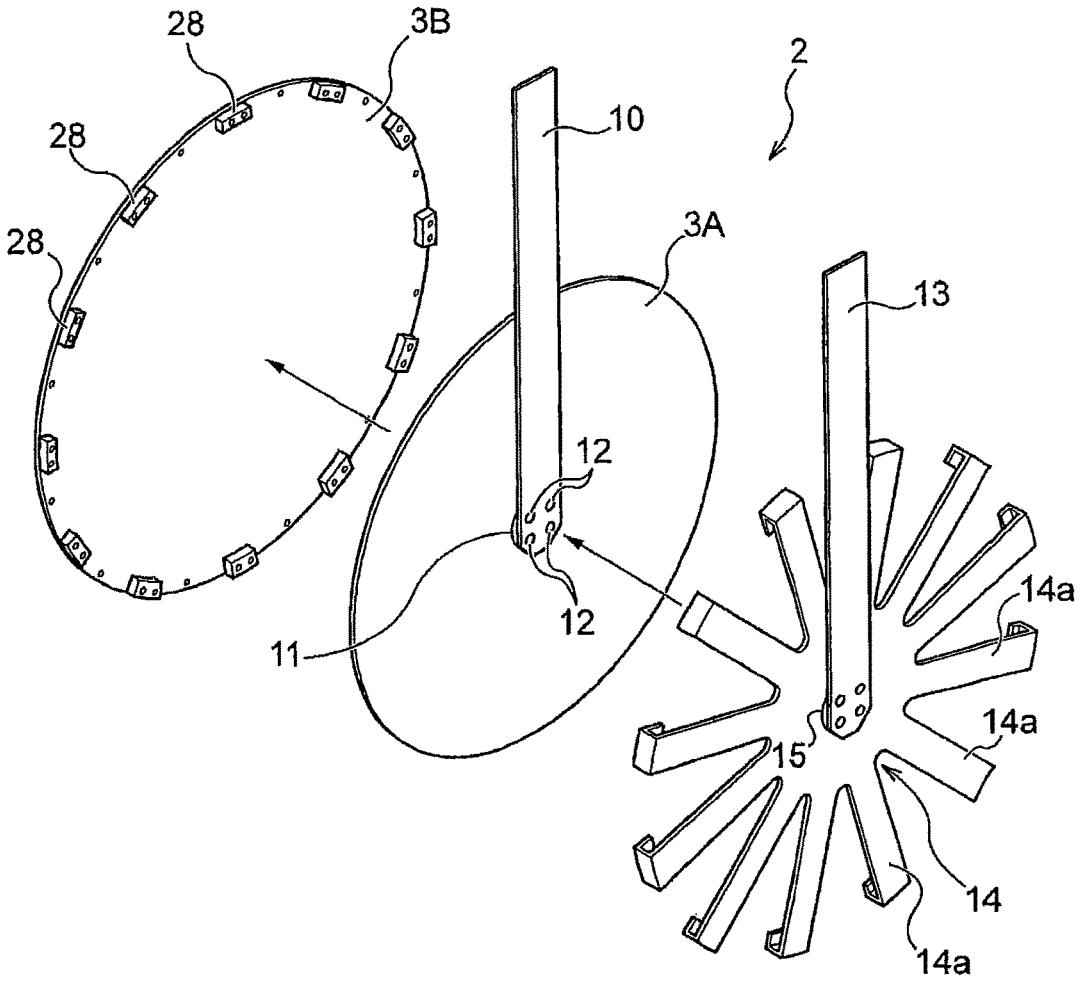
FIG. 7 is an exploded perspective view showing the components of the anode unit according to another embodiment.
Figure 8:
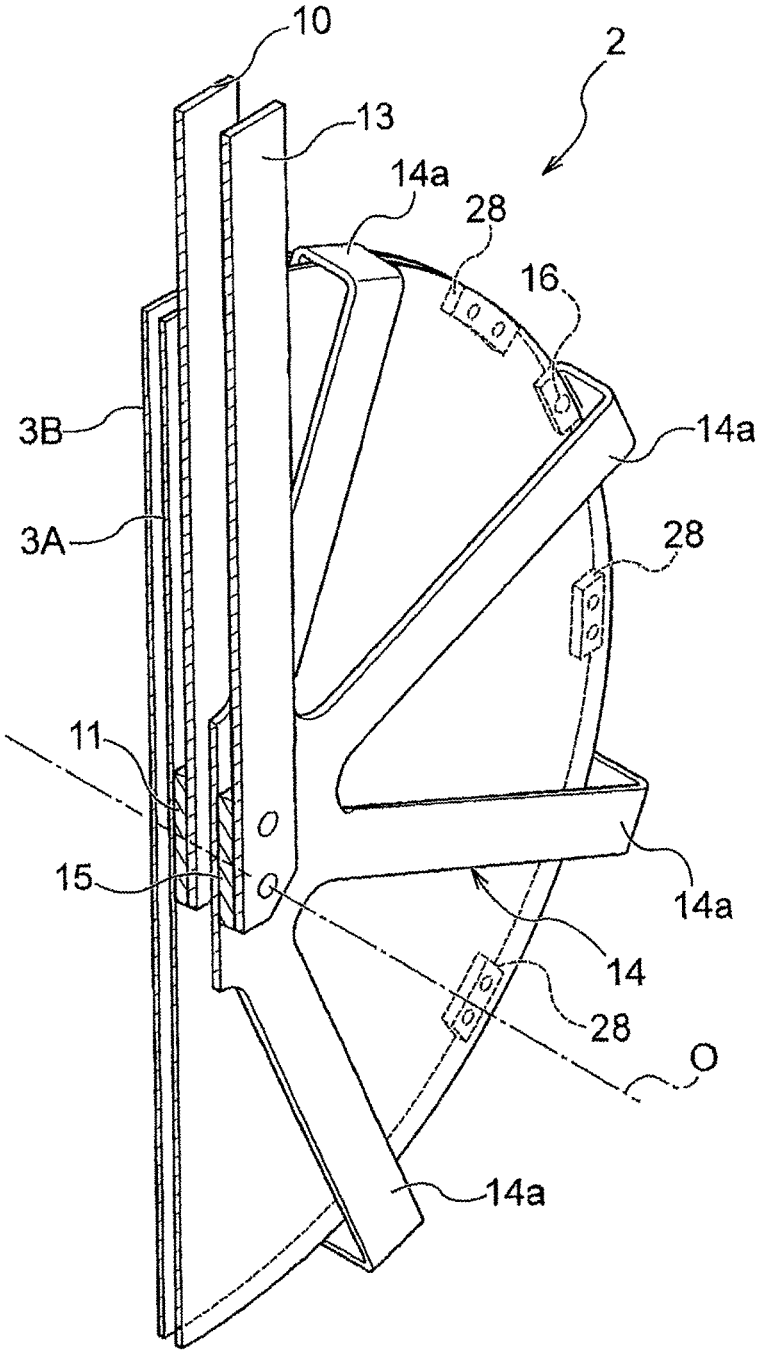
FIG. 8 is a cross-sectional perspective view of an assembly of the components of the anode unit shown in FIG. 7.
Figure 9:
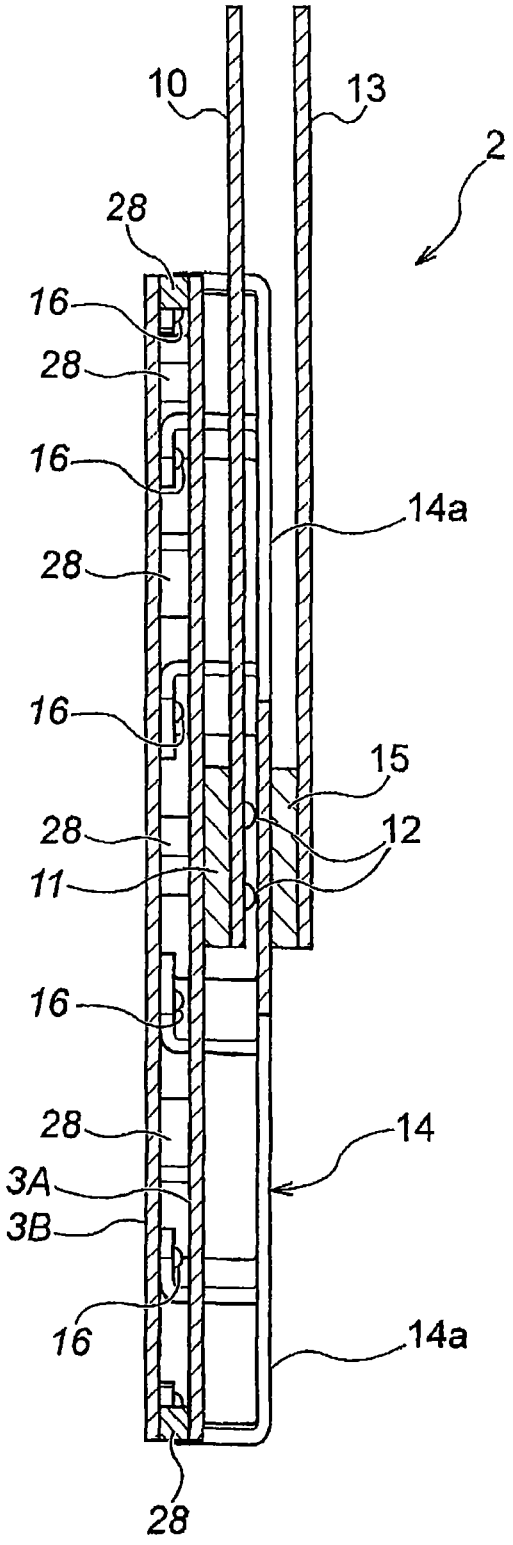
FIG. 9 is a cross-sectional view of the anode unit shown in FIG. 8.

Another embodiment of the anode unit 2 will now be described with reference to FIGS. 7 through 9. Structures of this embodiment, which are the same as those of the above-described embodiment, will not be described particularly, and their duplicate descriptions are omitted. FIG. 7 is an exploded perspective view showing components of the anode unit 2 according to another embodiment. FIG. 8 is a cross-sectional perspective view of an assembly of the components of the anode unit 2 shown in FIG. 7. FIG. 9 is a cross-sectional view of the anode unit 2 shown in FIG. 8. In this embodiment, the anode unit 2 includes two anodes: a first anode 3A and a second anode 3B. The second anode 3B is located nearer to the substrate W than the first anode 3A.

As shown in FIGS. 7 through 9, a first feeding portion 11 is connected to a central portion of the first anode 3A, and a plurality of arms 14*a* are connected to a periphery of the second anode 3B. More specifically, the first feeding portion 11 is fixed to the central portion of the first anode 3A by fastening tools 12 such as screws, and the distal ends of the arms 14*a* are fixed to the periphery of the second anode 3B by fastening tools 16 such as screws. As shown in FIG. 8, the arms 14*a* extend outside the periphery of the first anode 3A without contact with the first anode 3A, and are fixed to the periphery of the second anode 3B. A second feeding portion 15 lies on the central axis O of the anodes 3A, 3B and is located away from the anodes 3A, 3B.

A plurality of spacers 28, made of insulating material, are disposed between the first anode 3A and the second anode 3B, so that the spacers 28 form a constant gap between the first anode 3A and the second anode 3B. The first anode 3A and the second anode 3B are arranged away from each other and are parallel to each other. The anodes 3A, 3B have a disk shape with the same size. Further, the anodes 3A, 3B are arranged concentrically. The anodes 3A, 3B may have disk shapes of different sizes.

In general, a surface of an insoluble anode of some types may be covered with a coating material that inhibits consumption of additives (e.g., accelerator, suppressor) contained in a plating solution. However, if a current density on the surface of the anode is high, the coating material can peel off. According to the embodiment discussed above, the use of the two anodes 3A, 3B can increase a surface area of the entire anode. Therefore, the current densities on the surfaces of the anodes 3A, 3B can be decreased while maintaining the intensity of the electric field formed between the anodes 3A, 3B and a substrate W. Accordingly, the coating material can be prevented from peeing off the anodes 3A, 3B. Further, the consumption of the additives can be reduced by decreasing the current densities on the surfaces of the anodes 3A, 3B.

Further, according to this embodiment, a uniform electric field can be formed between the anodes 3A, 3B and the substrate W by passing electric currents to the central portion of the first anode 3A and to the periphery of the second anode 3B. Consequently, a metal film having a uniform thickness can be formed on the substrate W. In particular, in a case where the use of only the first anode 3A cannot form a metal film having a uniform thickness on the substrate W, the first anode 3A and the second anode 3B, having the feeding points different from the feeding point of the first anode 3A, are arranged away from and parallel to each other. By supplying electric currents of the same or different magnitudes to the anodes 3A, 3B, a metal film having a uniform thickness can be formed on the substrate W.

Figure 10A:
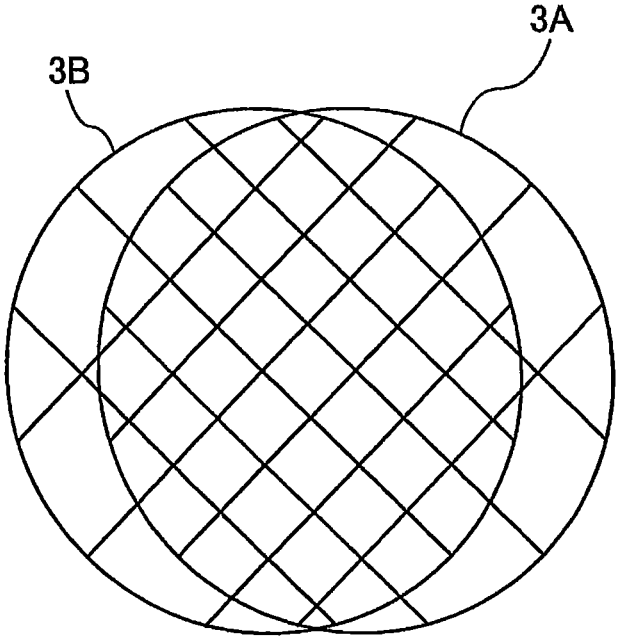
FIG. 10A is a view showing a first anode and a second anode that are laterally displaced slightly relative to each other.
Figure 10B:
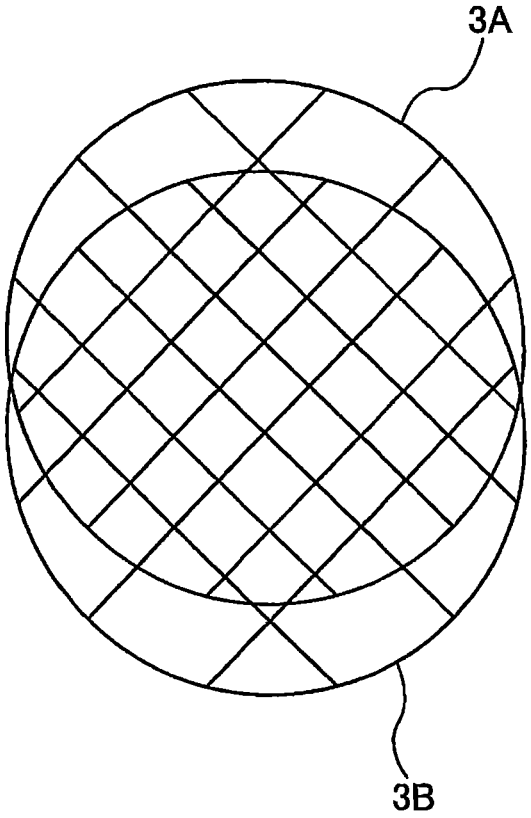
FIG. 10B is a view showing the first anode and the second anode that are vertically displaced slightly relative to each other.

The second anode 3B, which is located between the substrate W and the first anode 3A, may block the electric field generated between the first anode 3A and the substrate W. In view of this, the first anode 3A and the second anode 3B may be formed of a net-like lath material (or expanded metal). The lath material constituting the second anode 3B is disposed such that the second anode 3B does not overlap with the lath material constituting the first anode 3A when viewed from the front side of the first anode 3A and the second anode 3B. For example, as shown in FIG. 10A, the first anode 3A and the second anode 3B may be laterally displaced relative to each other by ½ of the pitch of the grid pattern of the lath material. Alternatively, as shown in FIG. 10B, the first anode 3A and the second anode 3B may be vertically displaced relative to each other by ½ of the pitch of the grid pattern of the lath material. Such arrangements can prevent the second anode 3B from shielding the electric field generated between the first anode 3A and the substrate W.

Figure 11:
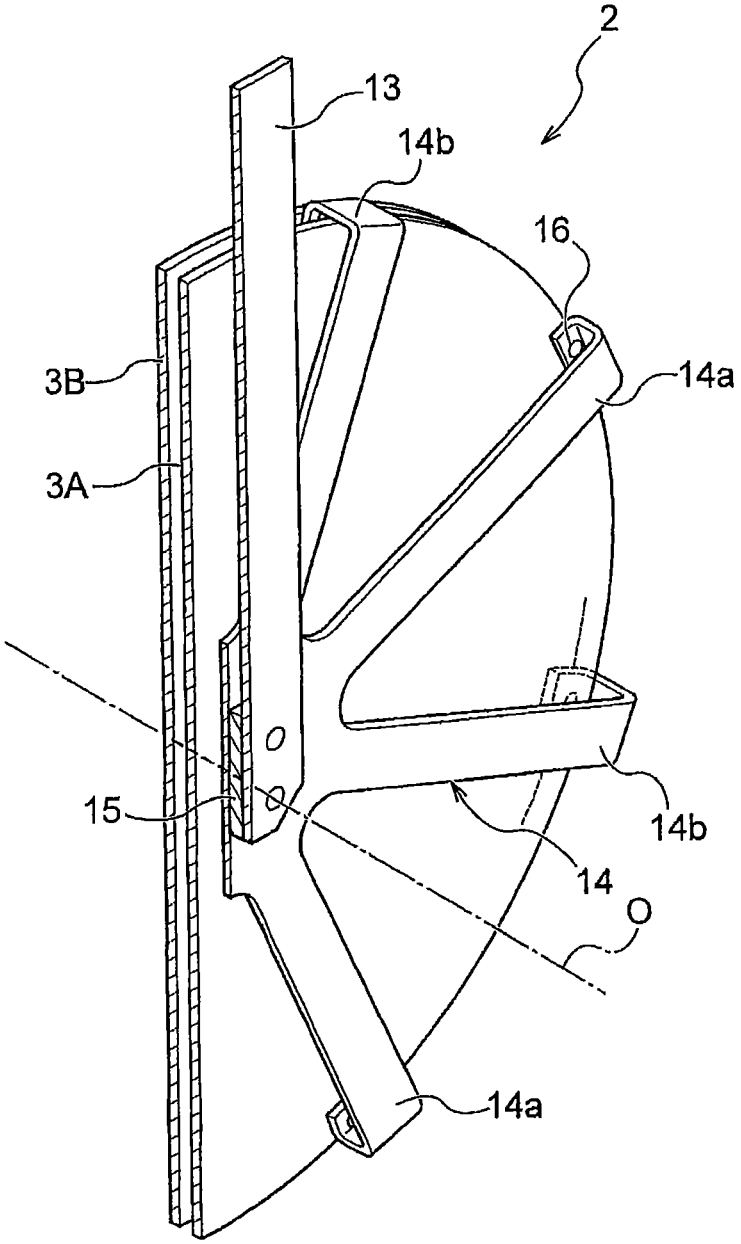
FIG. 11 is a cross-sectional perspective view of yet another embodiment of the anode unit.
Figure 12:
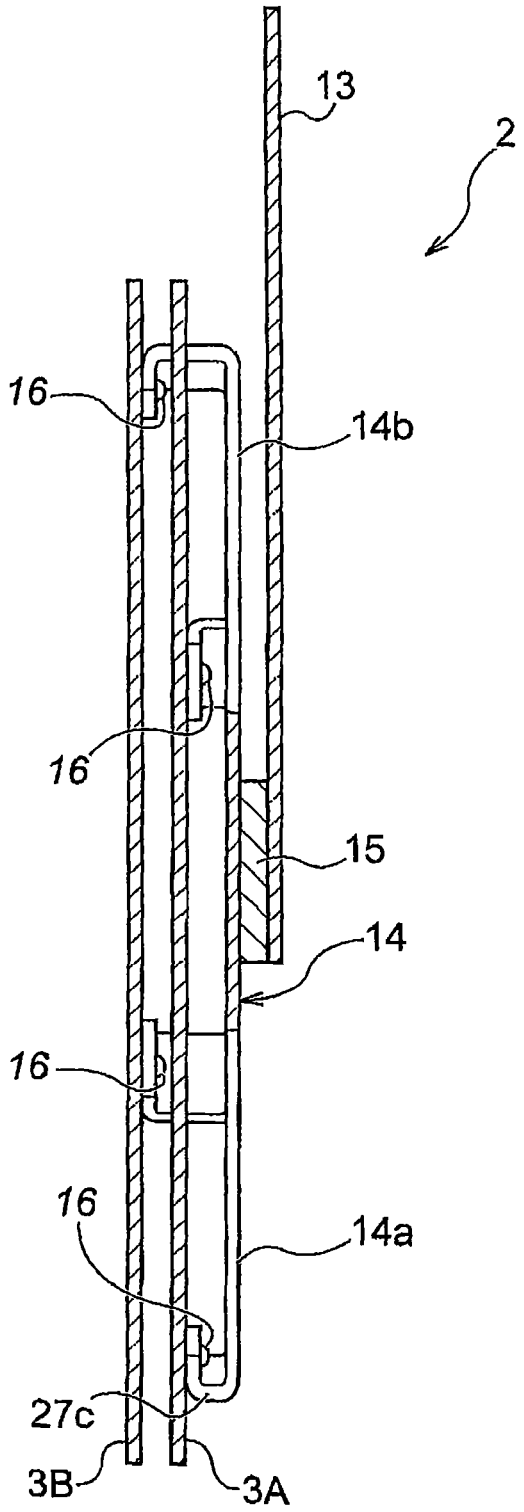
FIG. 12 is a cross-sectional view of the anode unit shown in FIG. 11.
Figure 13:
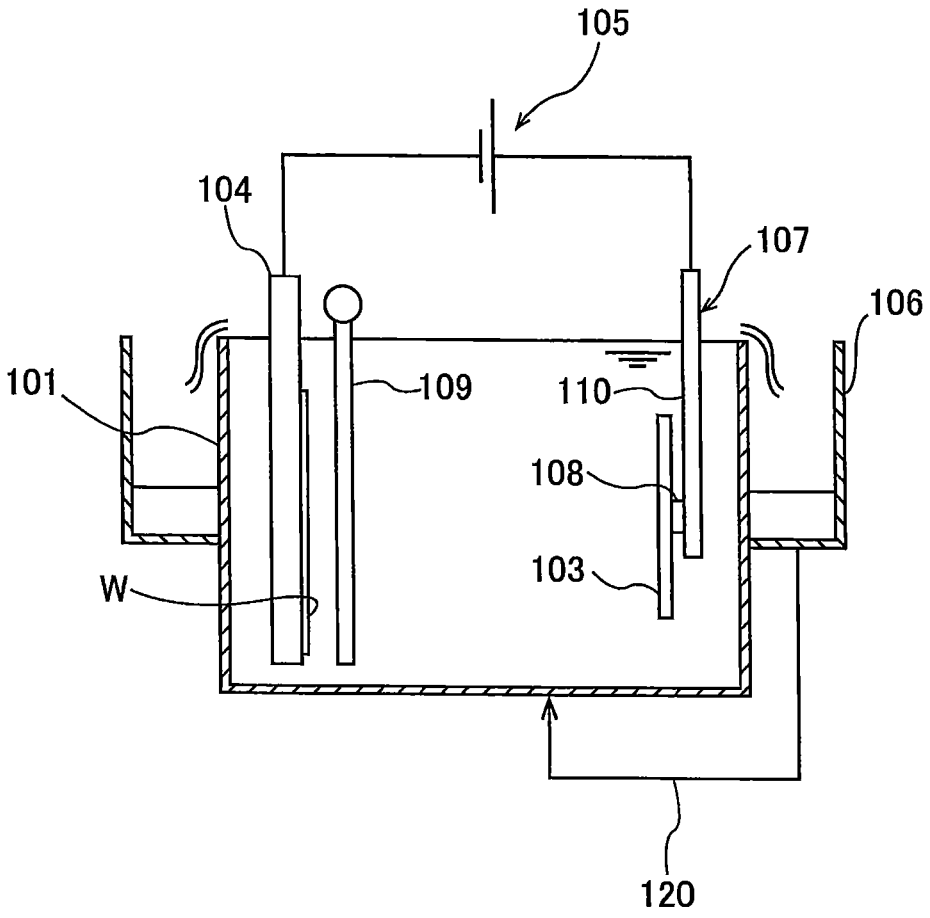
FIG. 13 is a schematic view of a typical plating apparatus.
Figure 14:
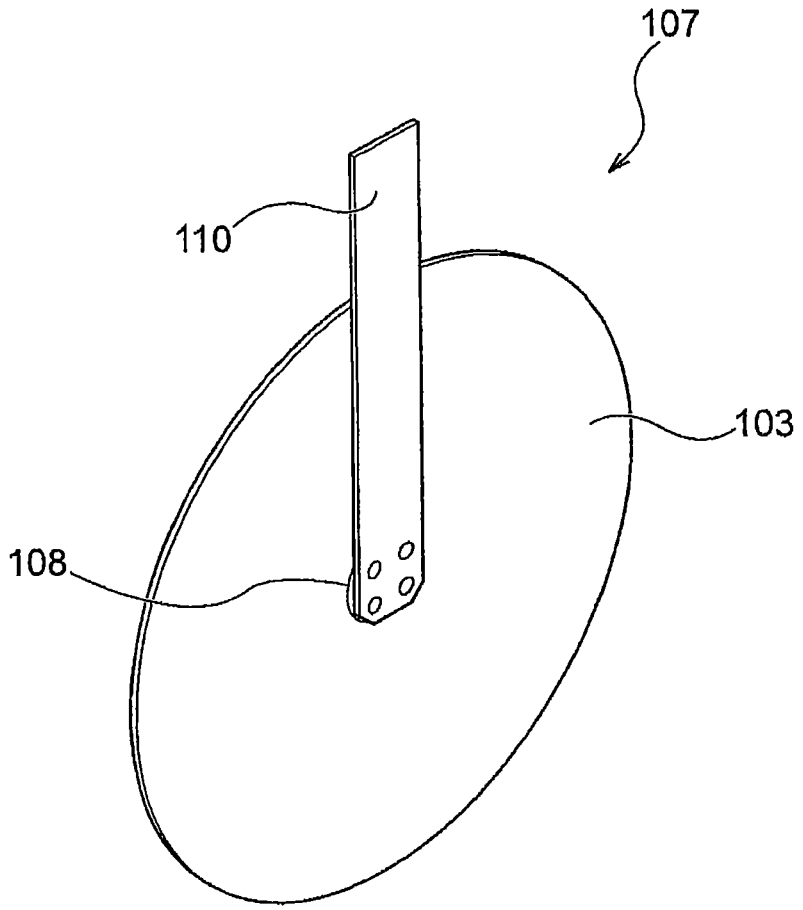
FIG. 14 is a perspective view of an anode unit shown in FIG. 13.
Figure 15:
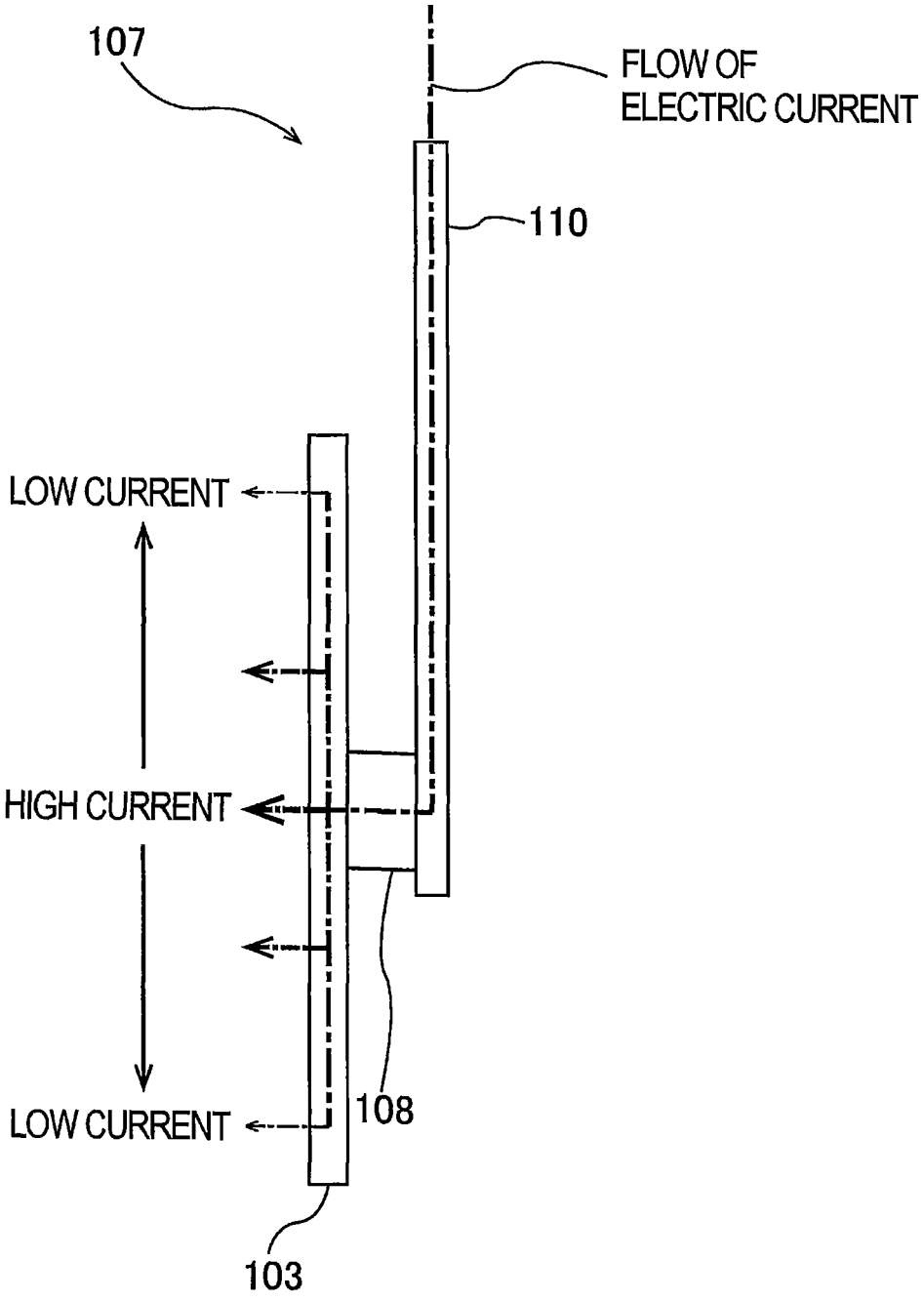
FIG. 15 is a side view of the anode unit shown in FIG. 14.

FIG. 11 is a cross-sectional perspective view of yet another embodiment of the anode unit 2. FIG. 12 is a cross-sectional view of the anode unit 2 shown in FIG. 11. As shown in FIGS. 11 and 12, the anode unit 2 of this embodiment is the same as the embodiment shown in FIG. 8 in that it has the two anodes 3A, 3B, but differs in that it does not have the first feeder belt 10 connected to the central portion of the anode 3A. Therefore, in the following description, the second feeder belt 13 will be referred to simply as feeder belt 13, and the second feeding portion 15 will be referred to simply as feeding portion 15. As with the embodiment shown in FIG. 8, the second anode 3B is disposed nearer to the substrate W than the first anode 3A.

The feeding portion 15 of the feeder belt 13 is connected to a periphery holding member 14 for holding the peripheries of the anodes 3A, 3B. The periphery holding member 14 has a plurality of first arms 14*a* and a plurality of second arms 14*b*. The feeding portion 15 is located on the central axis O of the anodes 3A, 3B and is located away from the anodes 3A, 3B. The arms 14*a*, 14*b* extend radially from the feeding portion 15. The first arms 14*a* and the second arms 14*b* are arranged alternately.

Distal ends of the first arms 14*a* are connected to the periphery of the first anode 3A, and distal ends of the second arms 14*b* are connected to the periphery of the second anode 3B. The first arms 14*a* are arranged at regular intervals along the circumferential direction of the first anode 3A, and the second arms 14*b* are arranged at regular intervals along the circumferential direction of the second anode 3B.

The distal ends of the arms 14*a*, 14*b* are bent toward the anodes 3A, 3B, and are fixed to the periphery of the anodes 3A, 3B by fastening tools 16 such as screws. The anodes 3A, 3B are held by the distal ends of the arms 14*a*, 14*b* such that the first anode 3A and the second anode 3B are arranged away from each other and parallel to each other.

The first arms 14*a* have the same length as each other, and the second arms 14*b* have the same length as each other. The first arms 14*a* have approximately the same length as the second arms 14*b*. The second arms 14*b* extend outside the periphery of the first anode 3A without contact with the first anode 3A, and are fixed to the periphery of the second anode 3B.

Also in this embodiment, the use of the two anodes 3A, 3B can increase the surface area of the entire anode. Therefore, the current densities on the surfaces of the anodes 3A, 3B can be decreased while maintaining the intensity of the electric field formed between the anodes 3A, 3B and a substrate W. This makes it possible to prevent peeling of a coating material from the anodes 3A, 3B and to prevent excessive consumption of additives contained in a plating solution.

Although the embodiments of the present invention have been described above, it should be understood that the present invention is not limited to the above embodiments, and various changes and modifications may be made without departing from the scope of the technical concept of the present invention.

What is claimed is:

1. An anode unit comprising:

an anode;

a first feeding portion electrically connected to a central portion of the anode;

a second feeding portion located on a central axis of the anode and located away from the anode; and arms extending radially from the second feeding portion, each of the arms being made of conductive material and being electrically connected to a periphery of the anode, the arms being arranged at regular intervals along a circumferential direction of the anode.

2. The anode unit according to claim 1, wherein the arms have the same length.

3. An anode unit comprising:

a first anode;

a second anode located away from the first anode and arranged parallel to the first anode;

a first feeding portion electrically connected to a central portion of the first anode;

a second feeding portion located on a central axis of the second anode and located away from the first anode and the second anode; and arms extending radially from the second feeding portion, each of the arms being made of conductive material and being electrically connected to a periphery of the second anode, the arms being arranged at regular intervals along a circumferential direction of the second anode.

4. The anode unit according to claim 3, wherein the arms have the same length.

5. An anode unit comprising:

a first anode and a second anode located away from each other and arranged parallel to each other;

a feeding portion located on a central axis of the first anode and the second anode and located away from the first anode and the second anode;

first arms extending radially from the feeding portion, each of the first arms being made of conductive material and being electrically connected to a periphery of the first anode, the first arms being arranged at regular intervals along a circumferential direction of the first anode; and second arms extending radially from the feeding portion, each of the second arms being made of conductive material and being electrically connected to a periphery of the second anode, the second arms being arranged at regular intervals along a circumferential direction of the second anode.

6. The anode unit according to claim 5, wherein the first arms have the same length, and the second arms have the same length.

7. A plating apparatus comprising:

a plating bath for holding a plating solution therein;

an anode unit having an anode to be immersed in the plating solution;

a substrate holder for holding a substrate to be immersed in the plating solution; and a first power source and a second power source each for applying a voltage between the substrate and the anode, the anode unit including:

a first feeding portion electrically connected to a central portion of the anode, the first feeding portion being electrically connected to the first power source;

a second feeding portion located on a central axis of the anode and located away from the anode, the second feeding portion being electrically connected to the second power source; and arms extending radially from the second feeding portion, each of the arms being made of conductive material and being electrically connected to a periphery of the anode, the arms being arranged at regular intervals along a circumferential direction of the anode.

8. The plating apparatus according to claim 7, wherein the arms have the same length.

9. The plating apparatus according to claim 7, wherein the first power source and the second power source are configured to independently apply a voltage between the substrate and the anode.

10. A plating apparatus comprising:

a plating bath for holding a plating solution therein;

an anode unit having an anode to be immersed in the plating solution;

a substrate holder for holding a substrate to be immersed in the plating solution; and a first power source and a second power source each for applying a voltage between the substrate and the anode, the anode unit including:

a first anode;

a second anode located away from the first anode and arranged parallel to the first anode;

a first feeding portion electrically connected to a central portion of the first anode, the first feeding portion being electrically connected to the first power source;

a second feeding portion located on a central axis of the second anode and located away from the first anode and the second anode, the second feeding portion being electrically connected to the second power source; and arms extending radially from the second feeding portion, each of the arms being made of conductive material and being electrically connected to a periphery of the second anode, the arms being arranged at regular intervals along a circumferential direction of the second anode.

11. The plating apparatus according to claim 10, wherein the arms have the same length.

12. A plating apparatus comprising:

a plating bath for holding a plating solution therein;

an anode unit having a first anode and a second anode to be immersed in the plating solution, the first anode and the second anode being located away from each other and arranged parallel to each other and;

a substrate holder for holding a substrate to be immersed in the plating solution; and a power source for applying a voltage between the substrate and the first and second anodes, the anode unit including:

a feeding portion located on a central axis of the first anode and the second anode and located away from the anodes;

first arms extending radially from the feeding portion, each of the first arms being made of conductive material and being electrically connected to a periphery of the first anode, the first arms being arranged at regular intervals along a circumferential direction of the first anode; and second arms extending radially from the feeding portion, each of the second arms being made of conductive material and being electrically connected to a periphery of the second anode, the second arms being arranged at regular intervals along a circumferential direction of the second anode.

13. The plating apparatus according to claim 12, wherein the first arms have the same length, and the second arms have the same length.

* * * * *